US011326824B2

(12) United States Patent
Moertl et al.

(10) Patent No.: US 11,326,824 B2
(45) Date of Patent: May 10, 2022

(54) HOUSEHOLD REFRIGERATION APPARATUS WITH AN ELONGATED ICE CHUTE

(71) Applicant: BSH HAUSGERAETE GMBH, Munich (DE)

(72) Inventors: Florian Moertl, Neu-Ulm (DE); Robert Stahl, Herbrechtingen (DE)

(73) Assignee: BSH Hausgeraete GmbH, Munich (DE)

( * ) Notice: Subject to any disclaimer, the term of this patent is extended or adjusted under 35 U.S.C. 154(b) by 341 days.

(21) Appl. No.: 16/706,049

(22) Filed: Dec. 6, 2019

(65) Prior Publication Data

US 2021/0172666 A1 Jun. 10, 2021

(51) Int. Cl.

| | |
|---|---|
| ***F25D 11/02*** | (2006.01) |
| ***F25C 5/20*** | (2018.01) |
| ***F25D 23/02*** | (2006.01) |

(52) U.S. Cl.

CPC ..... *F25C 5/22* (2018.01); *F25D 11/02* (2013.01); *F25D 23/028* (2013.01); *F25C 2400/04* (2013.01)

(58) Field of Classification Search

CPC ..... F25C 2400/04; F25C 5/22; F25D 11/02; F25D 23/028; F25D 23/126

See application file for complete search history.

(56) References Cited

U.S. PATENT DOCUMENTS

| | | | | |
|---|---|---|---|---|
| 9,423,167 | B2 | 8/2016 | Bowen et al. | |
| 10,603,612 | B2 * | 3/2020 | Chandra | B01D 29/15 |
| 2003/0089423 | A1 * | 5/2003 | Barton | B67D 1/00 141/198 |
| 2014/0182323 | A1 * | 7/2014 | Brunner | F25C 5/182 62/344 |

* cited by examiner

*Primary Examiner* — Filip Zec

(74) *Attorney, Agent, or Firm* — Laurence A. Greenberg; Werner H. Stemer; Ralph E. Locher

(57) ABSTRACT

A household refrigeration apparatus has a door with a rear side and an overhang. The overhang is arranged on the rear side and is formed with a top side wall. A water and ice dispenser is arranged in the door. The water and ice dispenser includes an elongated, or lengthened, ice chute. The ice chute is arranged in the overhang at least with an ice chute section. The ice chute is passed through the top side wall and the ice chute includes an entrance, which overhangs upwards beyond the top side wall in height direction of the household refrigeration apparatus and which is arranged above the top side wall at a distance to the top side wall.

13 Claims, 3 Drawing Sheets

HOUSEHOLD REFRIGERATION APPARATUS WITH AN ELONGATED ICE CHUTE

BACKGROUND OF THE INVENTION

Field of the Invention

One aspect of the invention relates to a household refrigeration apparatus.

Household refrigeration apparatuses, which comprise a dispenser for outputting water or ice, are known. Such household refrigeration apparatuses comprise a module in a receiving space. Usually, this module comprises an ice maker. Such a household refrigeration apparatus also comprises a dispenser separately to this ice maker. This dispenser is usually arranged in a door of the household refrigeration apparatus. In the closed state of the door, the ice maker is connected to the dispenser. Ice cubes, which are to be output, get from the ice maker into an ice chute arranged in the ice dispenser.

Such a configuration is known, for example, from U.S. Pat. No. 9,423,167 B2. The door comprises a rear side. In the closed state of the door, this rear side faces the receiving space. An overhang is formed on this rear side of the door. The ice chute is formed at this overhang. The overhang has an obliquely inclined surface. An entrance of this ice chute terminates at this top side. The entrance is arranged parallel to this top side of the overhang. The plane, in which the surface of the entrance of this ice chute is formed, is equal to the plane, in which the surface of the top side forms. This is disadvantageous with respect to the manufacture. Similarly, disadvantages with respect to the accessibility are also given thereby. Disadvantages with respect to the coupling to an exit of an ice maker are also present.

SUMMARY OF THE INVENTION

It is the object of the present invention to provide a household refrigeration apparatus, in which the ice chute is formed in improved manner.

With the above and other objects in view there is provided, in accordance with the invention, a household refrigeration apparatus comprising:

a door comprising a rear side and an overhang, which is arranged on the rear side, wherein the overhang comprises a top side wall, a water and ice dispenser, which is arranged in the door, wherein the water and ice dispenser comprises an ice chute, and the ice chute is arranged in the overhang at least with an ice chute section, wherein the ice chute is passed through the top side wall and the ice chute comprises an entrance, which overhangs upwards beyond the top side wall in height direction of the household refrigeration apparatus and is arranged above the top side wall at a distance to the top side wall.

According to another aspect of the present disclosure, the entrance is arranged completely without contact with the top side wall in height direction.

According to another aspect of the present disclosure, the top side wall and the entrance are arranged at an angle greater than or equal to 5° and less than or equal to 35° viewed in a vertical cross-section of the household refrigeration apparatus.

According to another aspect of the present disclosure, the surface of the entrance elongating in a first plane and the surface of top side wall elongating in a second plane and wherein said planes arranged inclined to each other with an angle greater than or equal to 5° and less than or equal to 35°.

According to another aspect of the present disclosure, the entrance comprises a radial ring flange.

According to another aspect of the present disclosure, a seal is arranged at the entrance.

According to another aspect of the present disclosure, the seal comprises a ring nut, into which a ring flange of the entrance is introduced.

According to another aspect of the present disclosure, the seal comprises an elastic sealing ring, which is hollow and which comprises a radial opening.

According to another aspect of the present disclosure, the sealing ring comprises a longitudinal axis and the radial opening is formed over the entire length of the sealing ring along this longitudinal axis.

According to another aspect of the present disclosure, the ice chute is a tube. The tube comprises a tube wall, wherein a tube volume of the tube is bounded by the tube wall. A flange is integrally formed on an outer side of the tube wall, by which the ice chute is attached to the top side wall.

According to another aspect of the present disclosure, the ice chute comprises a longitudinal axis and the flange is arranged at a distance to the entrance viewed in the direction of the longitudinal axis.

According to another aspect of the present disclosure, the ice chute comprises a longitudinal axis and the household refrigeration apparatus comprises a holder, wherein between the flange and the holder a receiving slit is arranged, wherein said slit is radially outwards open viewed to the longitudinal axis, into which the top side wall is introduced.

According to another aspect of the present disclosure, the household refrigeration apparatus comprises a housing and the door is pivotably arranged at the housing. The household refrigeration apparatus comprises an ice maker, which is arranged in the housing. The ice maker comprises an outlet opening, which is directly coupled to the entrance of the water and ice dispenser in the closed state of the door.

Further features of the invention are apparent from the claims, the figures and the description of figures. The features and feature combinations mentioned above in the description as well as the features and feature combinations mentioned below in the description of figures and/or shown in the figures alone are usable not only in the respectively specified combination, but also in other combinations without departing from the scope of the invention. Thus, implementations are also to be considered as encompassed and disclosed by the invention, which are not explicitly shown in the figures and explained, but arise from and can be generated by separated feature combinations from the explained implementations. Implementations and feature combinations are also to be considered as disclosed, which thus do not comprise all of the features of an originally formulated independent claim. Moreover, implementations and feature combinations are to be considered as disclosed, in particular by the implementations set out above, which extend beyond or deviate from the feature combinations set out in the back-references of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In the figures, identical or functionally identical parts are provided with the same reference signs.

With indications of "top", "bottom", "front", "rear", "horizontal", "vertical", "depth direction", "width direction", "height direction", etc., the positions and orientations given in intended use and intended arrangement of the apparatus are specified.

Figure 1:
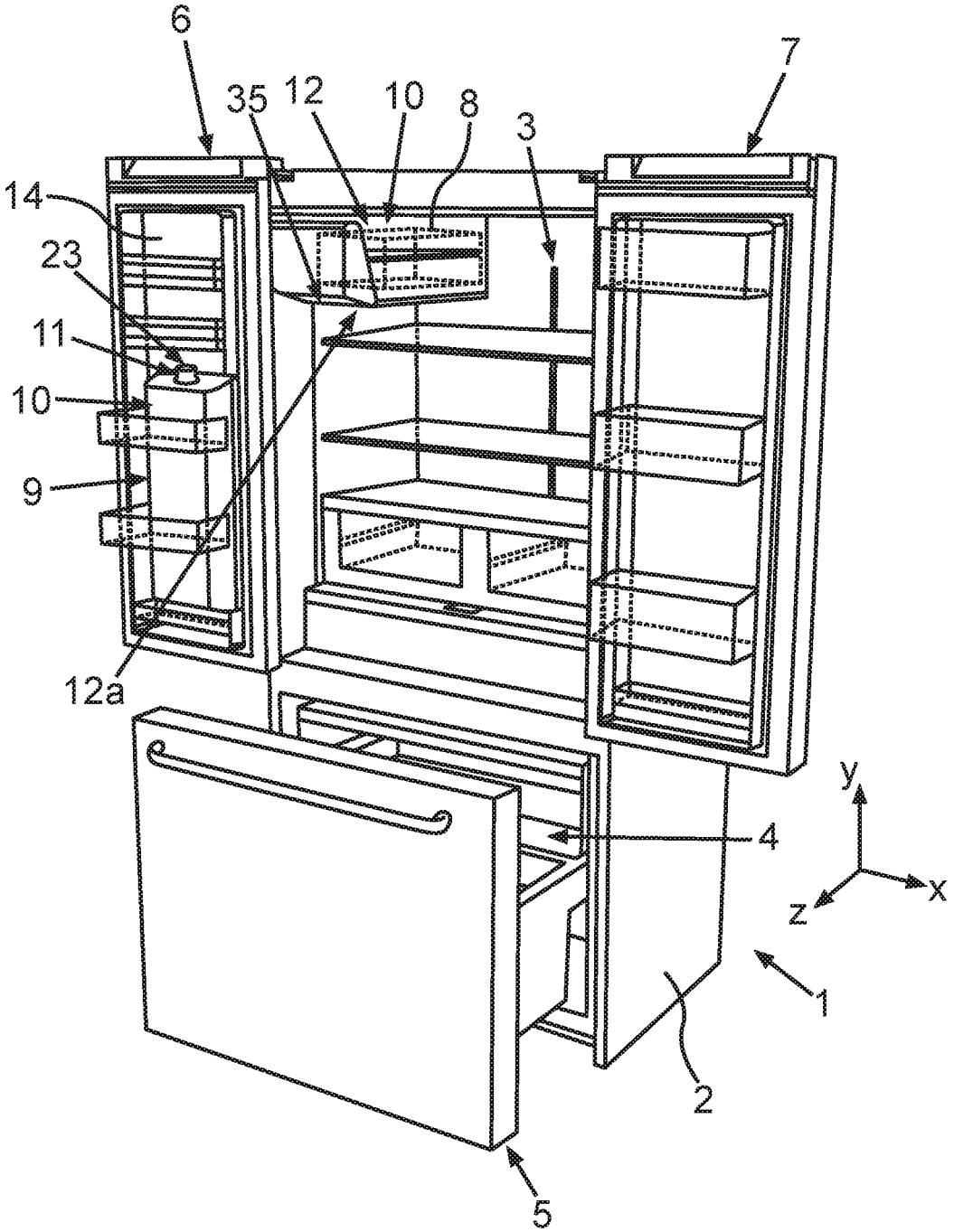
FIG. 1 is a perspective representation of an embodiment of a household refrigeration apparatus according to the invention.

In FIG. 1 in a perspective view an embodiment of a household cooling appliance 1 is shown. The household cooling appliance 1 is configured for storing and preserving food items. In the shown embodiment the household cooling appliance 1 is a fridge freezer combination appliance. However, it can also be only a cooling or refrigeration appliance.

The shown household cooling appliance 1 comprises an outer housing 2. In the outer housing a first receiving space for food items is configured, which here is a refrigeration compartment 3. In an embodiment the household cooling appliance 1 moreover comprises a second receiving space for food items, which is separate from the first receiving space and which here is a freezer compartment 4. As can be recognized, in the embodiment shown here the refrigeration compartment 3 and the freezer compartment 4 are arranged one above the other in the height direction (y-direction) of the household cooling appliance 1. The freezer compartment 4, which is arranged further below, is capable of being locked by a door 5. The door 5 in the shown embodiment is a front wall of a drawer, which can be shifted linearly in the depth direction (z direction) of the household cooling appliance 1. The refrigeration compartment 3 is capable of being locked by two separate doors 6 and 7, which are shown in FIG. 1 in the opened state. The two separate doors 6 and 7 are capable of being pivoted about pivot axles, which are vertically oriented, and are arranged on the outer housing 2. The two doors 6 and 7 are arranged adjacent to each other in the width direction (x direction) and extend in the closed state in a front side plane. In particular also the door 5 in the closed stated extends in this plane, in which also the two doors 6 and 7 extend in the closed state.

In an embodiment the household cooling appliance 1 moreover comprises a dispenser 10 configured to output ice form elements or crushed ice. The dispenser 10 moreover can also optionally be configured to output a drink. In an embodiment the household cooling appliance 1 comprises a module 8. In an embodiment the dispenser 10 comprises said module 8.

The module 8 in the shown embodiment is arranged in the interior of the refrigeration compartment 3. This means that whilst the module 8 is arranged to be thermally insulated against the refrigeration compartment 3, however, that it is only accessible and reachable via the feed opening of the refrigeration compartment 3. Thus, the module 8 can only be made accessible, when at least the door 6 is opened.

The dispenser 10 in addition to the module 8 also comprises an output 9. The output 9 here is for instance configured to be integrally formed in the door 6. On an outer side of the door 6, which faces away from the refrigeration compartment 3 and then is also a front side, a niche is formed, in which a receiving container can be placed and in which then via the output 9 the ice form elements or the crushed ice can be output.

In the closed state of the door 6 the output 9 is coupled with the module 8 so that via an ice chute 11 formed here in the output 9 ice form elements or crushed ice can arrive at the output 9 from the module 8.

The module 8 can be an ice compartment 12*a*. The household cooling appliance 1 can then also be configured without an ice maker 12. The module 8 can also be an ice maker 12. The ice compartment 12*a* can be an integral part of the ice maker 12 if the household cooling appliance 1 comprises an ice maker 12.

In FIG. 1 an example for a household cooling appliance 1 comprising an ice maker 12 is schematically shown. The ice maker 12 is arranged in the refrigeration compartment 3. Viewed from the front side, it is arranged in a left top corner portion of the refrigeration compartment 3. The ice maker 12 is arranged to be thermally insulated from the remaining volume of the receiving space 3. The ice maker is only accessible, if the door 6 is opened.

Figure 2:
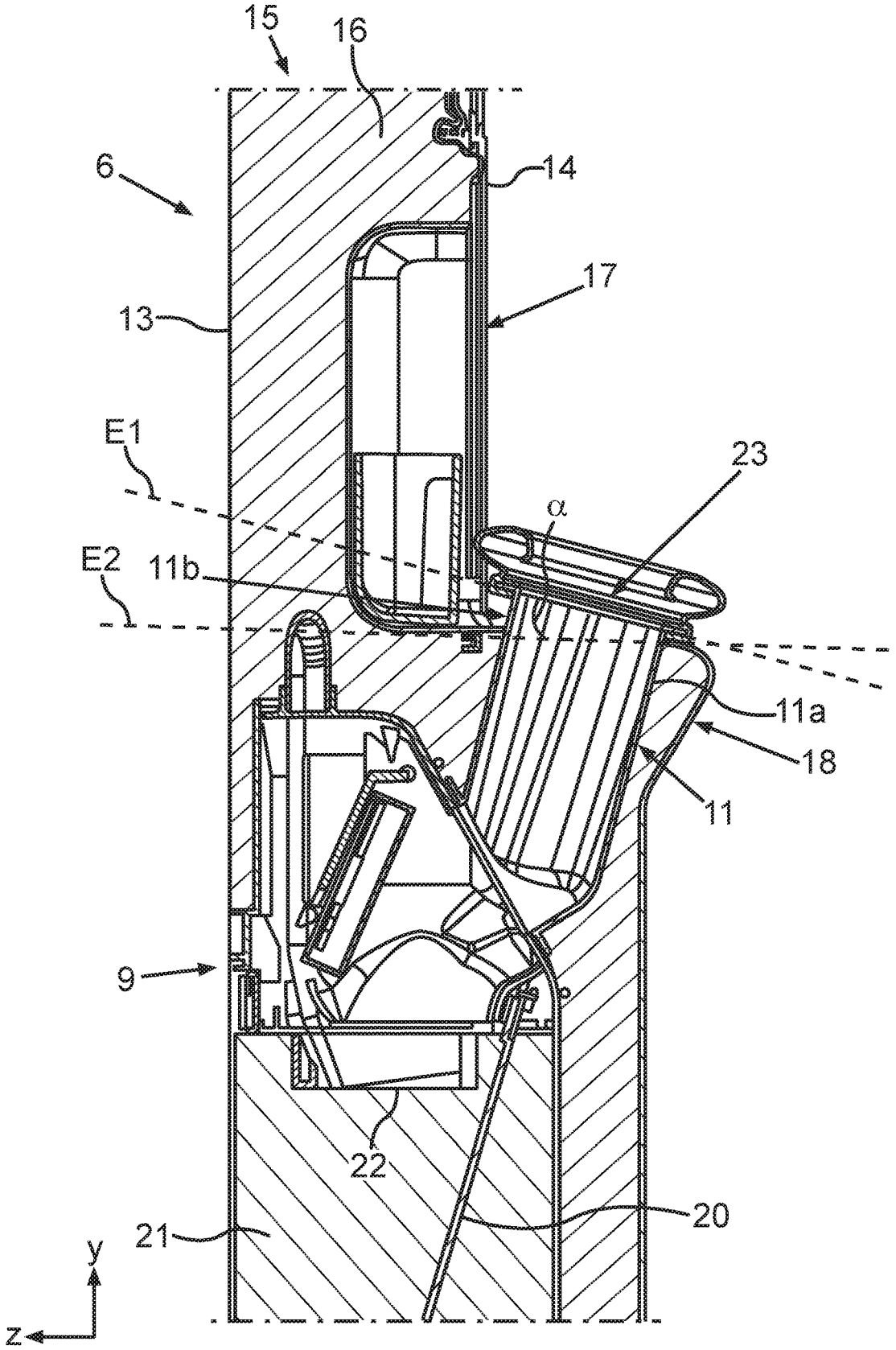
FIG. 2 is a sectional representation through a partial area of a door of the household refrigeration apparatus with a sectional representation through an ice chute of a dispenser arranged in the door.

In FIG. 2, a partial area of the door 6 is shown in a vertical sectional representation (sectional plane is the x-y-plane). The representation shows that the door 6 comprises a door outer wall 13 and a door inner wall 14. A clearance 15 between the door outer wall 13 and the door inner wall 14 is filled with a thermal isolation material 16. The thermal isolation material 16 can for example be a thermal isolation foam, such as for example a polyurethane foam. However, a vacuum isolation element can for example also be arranged in the clearance 15. The door 6 is shown in the closed state in FIG. 2.

The door 6 comprises a rear side 17. The rear side 17 is formed by the door inner wall 14. In the closed state of the door 6, this rear side 17 faces the receiving space 3. An overhang 18 is formed on this rear side 17. The overhang 18 is rearwards overhanging in depth direction (z-direction). Thus, it is overhanging facing the receiving space 3. Here, the overhang 18 is formed as a base. The ice chute 11 is arranged in this base. The overhang 18 comprises a top side wall 19. The top side wall 19 bounds the overhang 18 in height direction (y-direction). Therefore, the top side wall 19 represents the upper termination of the overhang 18.

In an embodiment, the ice chute 11 is a constituent of the dispenser 9. The dispenser 9 is arranged in the door 6. It is separate to the ice maker 12. In an embodiment, the dispenser 9 also comprises a paddle 20. It is arranged in a niche 21. The niche 21 in the door 6 is open on the front side. It can be gripped into the niche 21 to be able to actuate the paddle 20. In an embodiment, it can be rearwards pressed. Thereby, the output of water or ice is started. A vessel such as for example a drinking vessel can be placed in the niche 21. The water or the ice then arrives at the vessel placed in the niche 21 through an output opening 22.

The ice chute 11 comprises an entrance 23. The entrance 23 is thus the upper end of the ice chute 11. The entrance 23 faces away from the output opening 22. The entrance 23 faces the ice maker 12 when the door 6 is closed. In particular, an outlet opening 35 (FIG. 1) of the ice maker 12 is then coupled to the entrance 23. Ice, which is stored in a storing bowl of the ice maker 12, then gets from this storing container into the ice chute 11 and from there to the output opening 22. As is apparent in this sectional representation in FIG. 2, a plane E1, in which the surface of the entrance 23 extends, is oriented at an angle α to a plane E2. The plane E2 is that plane, in which the surface of the top side wall 19 extends. Thus, it is provided that these two planes E1 and E2 are arranged at an angle α to each other, which is preferably between 5° and 40°. In an embodiment, this angle α is between 10° and 15°. The entrance 23 is thus arranged upwards offset to the plane E2 in height direction (y-direction). Viewed in height direction, the entrance 23 is arranged completely spaced from and upwards offset to the top side wall 19.

In an embodiment the distance between the entrance 23 and the top side wall 19 is more than or equal 0.4 cm. In an embodiment the distance between the entrance 23 and the top side wall 19 is more than 1.0 cm. In an embodiment the distance between the entrance 23 and the top side wall 19 at a narrower side is more than or equal 0.4 cm. In an embodiment the distance varies in a direction around the axis A because of the inclination between the entrance 23 and the top side wall 19. The narrower distant side is in FIG. 2 and FIG. 3 on the right side. In an embodiment the distance between the entrance 23 and the top side wall 19 at a side more away than the narrower side is more than 1.0 cm. The side more away than the narrower side is in FIG. 2 and FIG. 3 on the left side.

The ice chute 11 is arranged in this overhang 18 at least with an ice chute section 11*a*. A further ice chute section 11*b* extends above this overhang 18 and above the top side wall 19. This ice chute section 11*b* forms a connector of the ice chute 11. This ice chute section 11*b* overhangs upwards from the overhang 18. The entrance 23 is arranged completely without contact with the top side wall 19 viewed in height direction.

Figure 3:
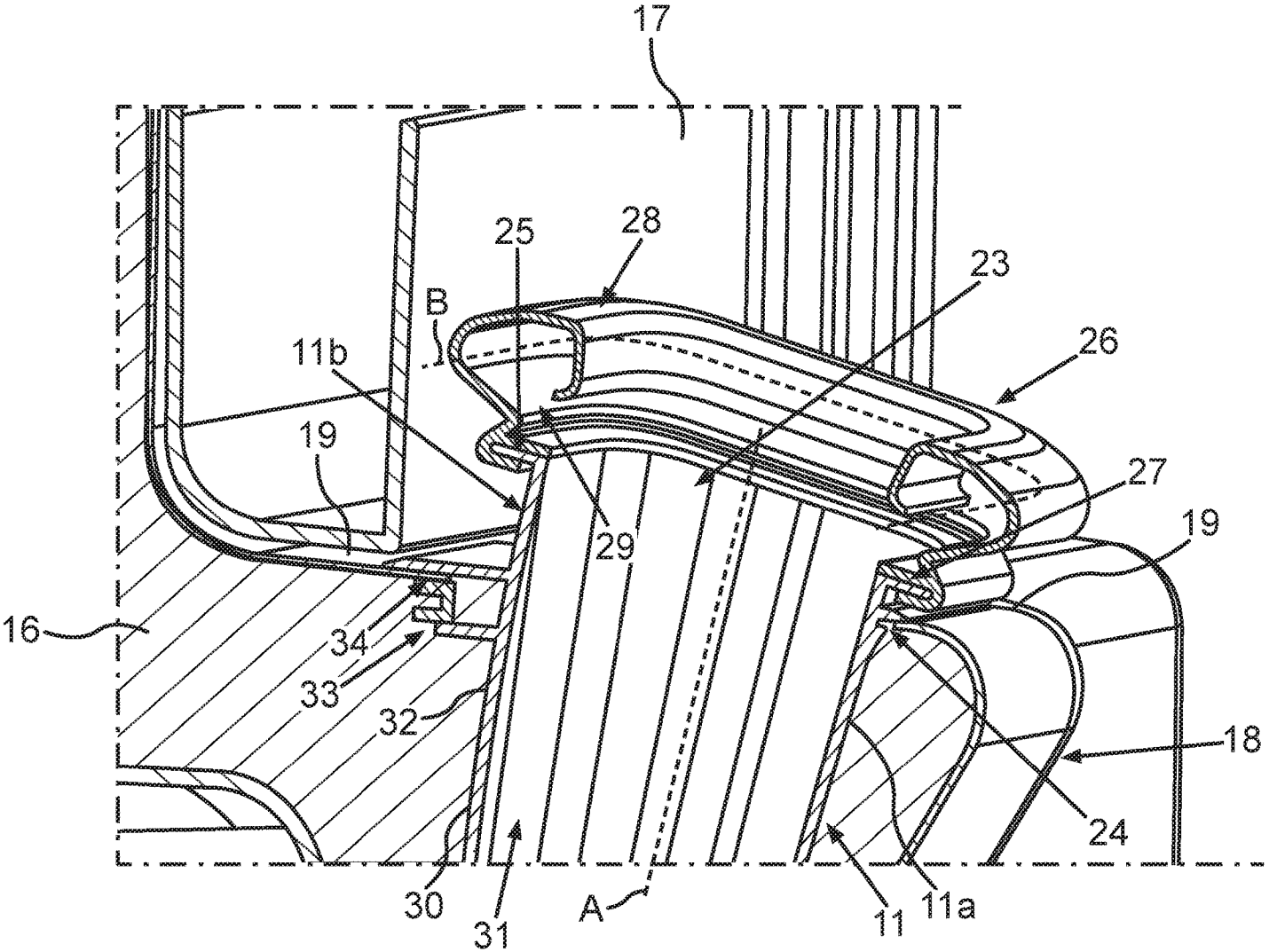
FIG. 3 is a perspective sectional representation of a partial area in FIG. 2.

In FIG. 3, a partial area of the arrangement in FIG. 2 is shown in an enlarged representation. In FIG. 3, a perspective sectional representation is shown in this context. It is apparent that the ice chute 11 is a separate component. Thus, it is formed separately to the top side wall 19. The ice chute 11 is attached to this top side wall 19. The ice chute 11 represents an integral component. In an embodiment, the ice chute 11 is formed of plastic. The ice chute 11 can be formed as an injection molded component.

The ice chute 11 is passed through an opening 24 in the top side wall 19. It extends on both sides of this opening 24. The entrance 23 is arranged at a distance to the top side wall 19. The entrance 23 is arranged completely spaced from the top side wall 19 viewed circumferentially around a longitudinal axis A of the ice chute 11.

In an embodiment, the entrance 23 is bounded by a ring flange 25.

The ring flange 25 is formed circumferentially around the longitudinal axis A. The ring flange 25 is completely closed in circumferential direction around this axis A. The ring flange 25 is oriented radially to the axis A. In an embodiment, a seal 26 is arranged at the entrance 23. In the embodiment, the seal 26 comprises a nut 27. The ring flange 25 is introduced into this nut 27. This nut 27 is a ring nut in an embodiment The seal 26 comprises an elastic sealing ring 28. This elastic sealing ring 28 is hollowly formed. This elastic sealing ring 28 comprises a radial opening 29. The radial opening 29 is to be understood in the direction of a longitudinal axis B of the sealing ring 28. The radial opening 29 is formed over the entire length of the sealing ring 28 viewed along this longitudinal axis B.

Coupling to the outlet opening 35 of the ice maker 12 is allowed by this seal 27 when the door 6 is closed.

In an embodiment, the ice chute 11 is a tube. The tube comprises a tube wall 30. A tube volume 31 is bounded by the tube wall. A holder 33 is arranged on an outer side 32 of the tube wall 30. In an embodiment, the holder 33 is formed integrally with the tube. The ice chute 11 is attached to the top side wall 19 by the holder 33. The holder 33 is formed spaced from and without contact with the entrance 23. The holder can be a separate part to the ice chute 11. In an embodiment in can be integrated in the ice chute 11.

In an embodiment, it is formed without contact with the ring flange 25. Between the holder 33 and a flange 36 there is a receiving slit 34. The flange is formed integrally at an outside of the ice chute 11. The top side wall 19 is passed into this slit 34. The holder 33 and the flange 36 are arranged at a distance to the entrance 23 viewed in the direction of the longitudinal axis A of the ice chute 11. A radially outwards open receiving slit is also formed by the slit 34.

Thereby, improved coupling of the entrance of the ice chute to the ice maker is allowed when the door is closed. A manufacturing method is to be seen as a particular advantage by this upwards overhanging configuration of the ice chute. Thus, the ice chute can be encompassed at its upper end by a tool in the foaming process and is thus more stably positioned and retained.

A further advantage is higher flexibility in the configuration of the entrance of the ice chute. If this entrance is arranged spaced upwards from the top side, here, a geometry and orientation independent of the shape of the top side can be formed. Improved coupling of the entrance of the ice chute to the ice maker can be allowed thereby too. Thus, it is allowed that the ice chute, in particular the entrance, can be changed independently of the overhang. The assembly effort also reduces by the achieved omission of a separate sealing holder. Moreover, simple assembly and disassembly of a seal arranged at the entrance of the ice chute is allowed. Because the accessibility is simplified. The production of the ice chute is simplified since internal sliders of an injection molding tool are not required. Moreover, simplified cleaning is allowed. Gaps are not present within the ice chute. This favors the cleanability of the ice chute. This particularly favors the cleanability of the entrance of the ice chute.

Moreover, pockets for snap hooks or gaps, in which ice could get caught or could unintentionally deposit, are not present. Not least, better capability of positioning this ice chute during the foaming process is moreover allowed. This, since encompassing the ice chute from the outside is possible. Especially by upwards overhanging, the entrance can be correspondingly gripped from the outside. Since the ice chute either is not completely foamed by this overhang, there also arises more usable volume. Thus, more space for a door shelf is in particular provided at the door. By the separation of the planes of the top side of the overhang on the one hand, of the entrance of the ice chute on the other hand, an approximately horizontal plane for a door shelf at the door can also be realized. Moreover, expensive adaptation of the drawing and foaming tools, which are otherwise required for adapting the ice chute, is omitted in production.

In an embodiment, the entrance is arranged completely without contact with the top side wall in height direction.

In an embodiment, the top side wall and the entrance are arranged at an angle greater than or equal to 5° and less than or equal to 35° viewed in a vertical cross-section of the household refrigeration apparatus.

In an embodiment, the surface of the entrance elongating in a first plane and the surface of top side wall elongating in a second plane and wherein said planes arranged inclined to each other with an angle greater than or equal to 5° and less than or equal to 35°.

In an embodiment, the entrance comprises a radial ring flange.

In an embodiment, a seal is arranged at the entrance.

In an embodiment, the seal comprises a ring nut, into which a ring flange of the entrance is introduced.

In an embodiment, the seal comprises an elastic sealing ring, which is hollow and which comprises a radial opening.

In an embodiment, the sealing ring comprises a longitudinal axis and the radial opening is formed over the entire length of the sealing ring along this longitudinal axis.

In an embodiment, the ice chute is a tube. The tube comprises a tube wall, wherein a tube volume of the tube is bounded by the tube wall. A flange is integrally formed on an outer side of the tube wall, by which the ice chute is attached to the top side wall.

In an embodiment, the ice chute comprises a longitudinal axis and the flange is arranged at a distance to the entrance viewed in the direction of the longitudinal axis.

In an embodiment, the ice chute comprises a longitudinal axis and the household refrigeration apparatus comprises a holder, wherein between the flange and the holder a receiving slit is arranged, wherein said slit is radially outwards open viewed to the longitudinal axis, into which the top side wall is introduced.

In an embodiment, the household refrigeration apparatus comprises a housing and the door is pivotably arranged at the housing. The household refrigeration apparatus comprises an ice maker, which is arranged in the housing. The ice maker comprises an outlet opening, which is directly coupled to the entrance of the water and ice dispenser in the closed state of the door.

The following is a list of reference numerals used in the above description of the invention with reference to the drawing figures:

1 household cooling appliance
2 outer housing
3 refrigeration compartment
4 freezer compartment
5 door
6 door
7 door
8 module
9 output
10 dispenser
11 ice chute
11*a* ice chute section
11*b* ice chute section
12 ice maker
12*a* ice compartment
13 door outer wall
14 door inner wall
15 clearance
16 thermal isolation material
17 rear side
18 overhang
19 top side wall
20 paddle
21 niche
22 output opening
23 entrance
24 opening
25 ring flange
26 seal
27 nut
28 sealing ring
29 radial opening
30 tube wall
31 tube volume
32 outer side
33 holder
34 slit
35 outlet opening
36 flange
y height direction
z depth direction
α angle
A axis
B axis
E1 plane
E2 plane

The invention claimed is:

1. A household refrigeration apparatus, comprising:

a door having a rear side and an overhang, wherein the overhang is arranged on the rear side and the overhang includes a top side wall, a water and ice dispenser arranged in the door, wherein the water and ice dispenser includes an ice chute arranged in the overhang at least with an ice chute section, wherein the ice chute passes through the top side wall and the ice chute includes an entrance, which overhangs upwards beyond the top side wall in height direction of the household refrigeration apparatus and which is arranged above the top side wall at a distance from the top side wall.

2. The household refrigeration apparatus according to claim 1, wherein the entrance is arranged completely without contact with the top side wall in height direction.

3. The household refrigeration apparatus according to claim 1, wherein the top side wall and the entrance are arranged at an angle greater than or equal to 5° and less than or equal to 35° viewed in a vertical cross-section of the household refrigeration apparatus.

4. The household refrigeration apparatus according to claim 3, wherein the surface of the entrance elongating in a first plane and the surface of top side wall elongating in a second plane and wherein said planes arranged inclined to each other with an angle greater than or equal to 5° and less than or equal to 35°.

5. The household refrigeration apparatus according to claim 1, wherein the entrance comprises a radial ring flange.

6. The household refrigeration apparatus according to claim 1, wherein a seal is arranged at the entrance.

7. The household refrigeration apparatus according to claim 6, wherein the seal comprises a ring nut, into which a ring flange of the entrance is introduced.

8. The household refrigeration apparatus according to claim 6, wherein the seal comprises an elastic sealing ring, which is hollow and which comprises a radial opening.

9. The household refrigeration apparatus according to claim 8, wherein the sealing ring comprises a longitudinal axis, and the radial opening is formed over the entire length of the sealing ring along this longitudinal axis.

10. The household refrigeration apparatus according to claim 1, wherein the ice chute is a tube, which comprises a tube wall, wherein a tube volume of the tube is bounded by the tube wall, wherein a flange is integrally formed on an outer side of the tube wall, by which the ice chute is attached to the top side wall.

11. The household refrigeration apparatus according to claim 10, wherein the ice chute comprises a longitudinal axis and the flange is arranged at a distance to the entrance viewed in the direction of the longitudinal axis.

12. The household refrigeration apparatus according to claim 10, wherein the ice chute comprises a longitudinal axis and the household refrigeration apparatus comprises a holder, wherein between the flange and the holder a receiving slit is arranged, wherein said slit is radially outwards open viewed to the longitudinal axis, into which the top side wall is introduced.

13. The household refrigeration apparatus according to claim 1, wherein the household refrigeration apparatus comprises a housing, and the door is pivotably arranged at the housing, wherein the household refrigeration apparatus comprises an ice maker, which is arranged in the housing, wherein the ice maker comprises an outlet opening, which is directly coupled to the entrance of the water and ice dispenser in the closed state of the door.

* * * * *